US011349210B2

(12) United States Patent
Li et al.

(10) Patent No.: US 11,349,210 B2
(45) Date of Patent: May 31, 2022

(54) ELECTRONIC DEVICE AND ANTENNA MODULE

(71) Applicant: WISTRON NEWEB CORPORATION, Hsinchu (TW)

(72) Inventors: Kuan-Hung Li, Hsinchu (TW); Shang-Ching Tseng, Hsinchu (TW); Yu-Yu Chiang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 31 days.

(21) Appl. No.: 17/149,785

(22) Filed: Jan. 15, 2021

(65) Prior Publication Data

US 2021/0359410 A1 Nov. 18, 2021

(30) Foreign Application Priority Data

May 18, 2020 (TW) ..... 109116357

(51) Int. Cl.

| | |
|---|---|
| ***H01Q 13/10*** | (2006.01) |
| ***H01Q 5/10*** | (2015.01) |
| ***H01Q 5/35*** | (2015.01) |
| ***H01Q 1/38*** | (2006.01) |

(52) U.S. Cl.

CPC ..... *H01Q 5/10* (2015.01); *H01Q 1/38* (2013.01); *H01Q 5/35* (2015.01); *H01Q 13/10* (2013.01)

(58) Field of Classification Search

CPC ..... H01Q 5/10; H01Q 1/38; H01Q 13/10; H01Q 1/246; H01Q 1/44; H01Q 7/00; H01Q 5/35; H01Q 5/385; H01Q 9/42

See application file for complete search history.

(56) References Cited

U.S. PATENT DOCUMENTS

2008/0231522 A1* 9/2008 Montgomery ..... H01Q 13/10 343/702

2010/0225544 A1* 9/2010 Taura ..... H01Q 1/243 343/702

FOREIGN PATENT DOCUMENTS

TW 201906228 A 2/2019

* cited by examiner

*Primary Examiner* — David E Lotter

(74) *Attorney, Agent, or Firm* — McClure, Qualey & Rodack, LLP

(57) ABSTRACT

An electronic device and an antenna module are provided. The electronic device includes a metal cover and the antenna module. The metal cover has a short slot and a long slot. The antenna module includes a substrate and an antenna structure. The antenna structure includes a first excitation segment, a second excitation segment, and a connection segment. Two projection regions respectively defined by orthogonally projecting the first excitation segment and the second excitation segment onto the metal cover overlap with the shot slot and the long slot, respectively. When a signal source is fed into the antenna structure, a first frequency band generated by the antenna structure and the short slot, a second frequency band generated by the antenna structure and the long slot, and a third frequency band generated by the antenna structure are different from each other in terms of corresponding frequency ranges.

19 Claims, 12 Drawing Sheets

ELECTRONIC DEVICE AND ANTENNA MODULE

CROSS-REFERENCE TO RELATED PATENT APPLICATION

This application claims the benefit of priority to Taiwan Patent Application No. 109116357, filed on May 18, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electronic device and an antenna module, and more particularly to an electronic device suited for three different frequency bands and an antenna module that is suited for three different frequency bands.

BACKGROUND OF THE DISCLOSURE

In order for a conventional electronic device, such as smartphones, tablets, and laptops, to perform wireless communication in different frequency bands, related manufacturers often install a plurality of antennas in the conventional electronic device, so as to enable the electronic device to communicate wirelessly in different frequency bands through the different antennas.

In practical applications, when a space for installing the antennas in the conventional electronic device is relatively small, the related manufacturers will face a problem of not being able to install a plurality of antennas at the same time. Therefore, how the antennas can be designed so as to be installed in a relatively small space of an electronic device has become an issue that confronts the related manufacturers.

SUMMARY OF THE DISCLOSURE

In response to the above-referenced technical inadequacies, the present disclosure provides an electronic device and an antenna module, which are mainly used to improve the design of a conventional electronic device that needs to have a plurality of antennas installed therein in order to receive a plurality of wireless signals in different frequency bands. As the overall size of current electronic devices is to be thinner and lighter, it is not easy for related manufacturers to install the antennas that receive different frequency bands in the current electronic devices while maintaining the receiving efficiency of the antennas.

In one aspect, the present disclosure provides an electronic device. The electronic device includes a metal cover and an antenna module.

The metal cover has two slots. The two slots are respectively defined as a short slot and a long slot, and a length of the short slot is less than a length of the long slot. The short slot and the long slot each penetrate the metal cover and are arranged side by side. The antenna module includes a substrate and an antenna structure. The substrate is disposed on a side of the metal cover. The antenna structure is a conductive structure and is formed on a surface of the substrate. The antenna structure defines a feeding portion. The antenna structure includes a first excitation segment, a second excitation segment, and a connection segment. At least part of a projection region defined by orthogonally projecting the first excitation segment onto the metal cover overlaps with the short slot. At least part of a projection region defined by orthogonally projecting the second excitation segment onto the metal cover is overlapped with the long slot. The connection segment is connected to the first excitation segment and the second excitation segment. When a signal source is fed into the antenna structure through the feeding portion, the antenna structure and the short slot are configured to generate a first frequency band, the antenna structure and the long slot are configured to generate a second frequency band, and the antenna structure is configured to generate a third frequency band. A frequency range corresponding to the first frequency band, a frequency range corresponding to the second frequency band, and a frequency range corresponding to the third frequency band are different from each other.

In another aspect, the present disclosure provides an antenna module for being fixed onto a metal cover that has a short slot and a long slot. A length of the short slot is less than a length of the long slot, and the short slot and the long slot each penetrate the metal cover and are arranged side by side. The antenna module includes a substrate and an antenna structure.

The substrate is disposed on a side of the metal cover. The antenna structure is a conductive structure and is formed on a surface of the substrate. The antenna structure defines a feeding portion. The antenna structure includes a connection segment, a first excitation segment, and a second excitation segment.

The first excitation segment extends from one end of the connection segment along an extension direction. At least part of a projection region defined by orthogonally projecting the first excitation segment onto the metal cover overlaps with the short slot. The second excitation segment extends from another end of the connection segment along the extension direction. At least part of a projection region defined by orthogonally projecting the second excitation segment onto the metal cover overlaps with the long slot. When a signal source is fed into the antenna structure through the feeding portion, the antenna structure and the short slot are configured to generate a first frequency band, the antenna structure and the long slot are configured to generate a second frequency band, and the antenna structure is configured to generate a third frequency band.

Therefore, by virtue of "the first excitation segment, the second excitation segment, and the connection segment of the antenna structure" and "the long slot and the short slot of the metal cover", when the signal source is fed into the antenna structure through the feeding portion of the antenna structure, the antenna module can generate three different frequency bands.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
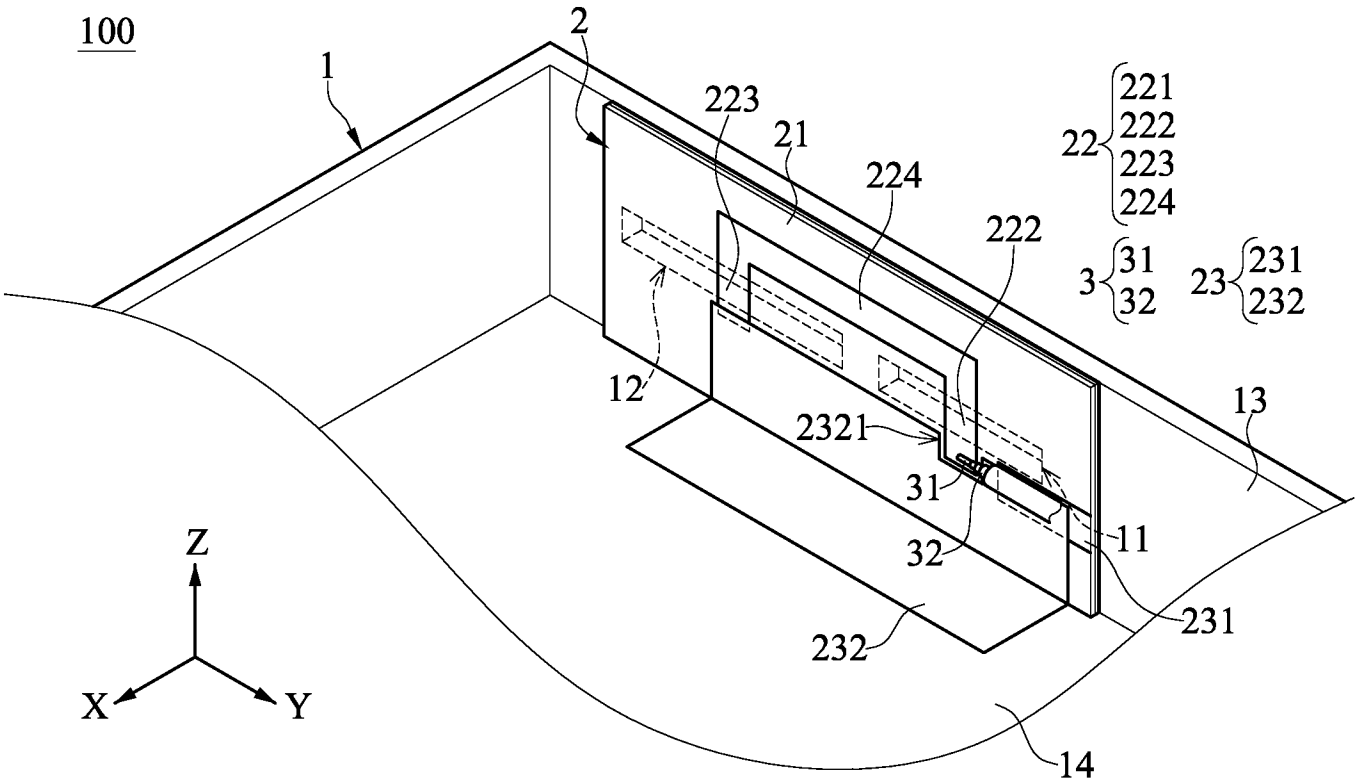
FIG. 1 is a schematic partial perspective view of an electronic device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

In the following description, the word "couple" indicates a connection method that allows an electrical connection to be formed through direct or indirect conduction, and yet not in direct contact.

First Embodiment

Figure 2:
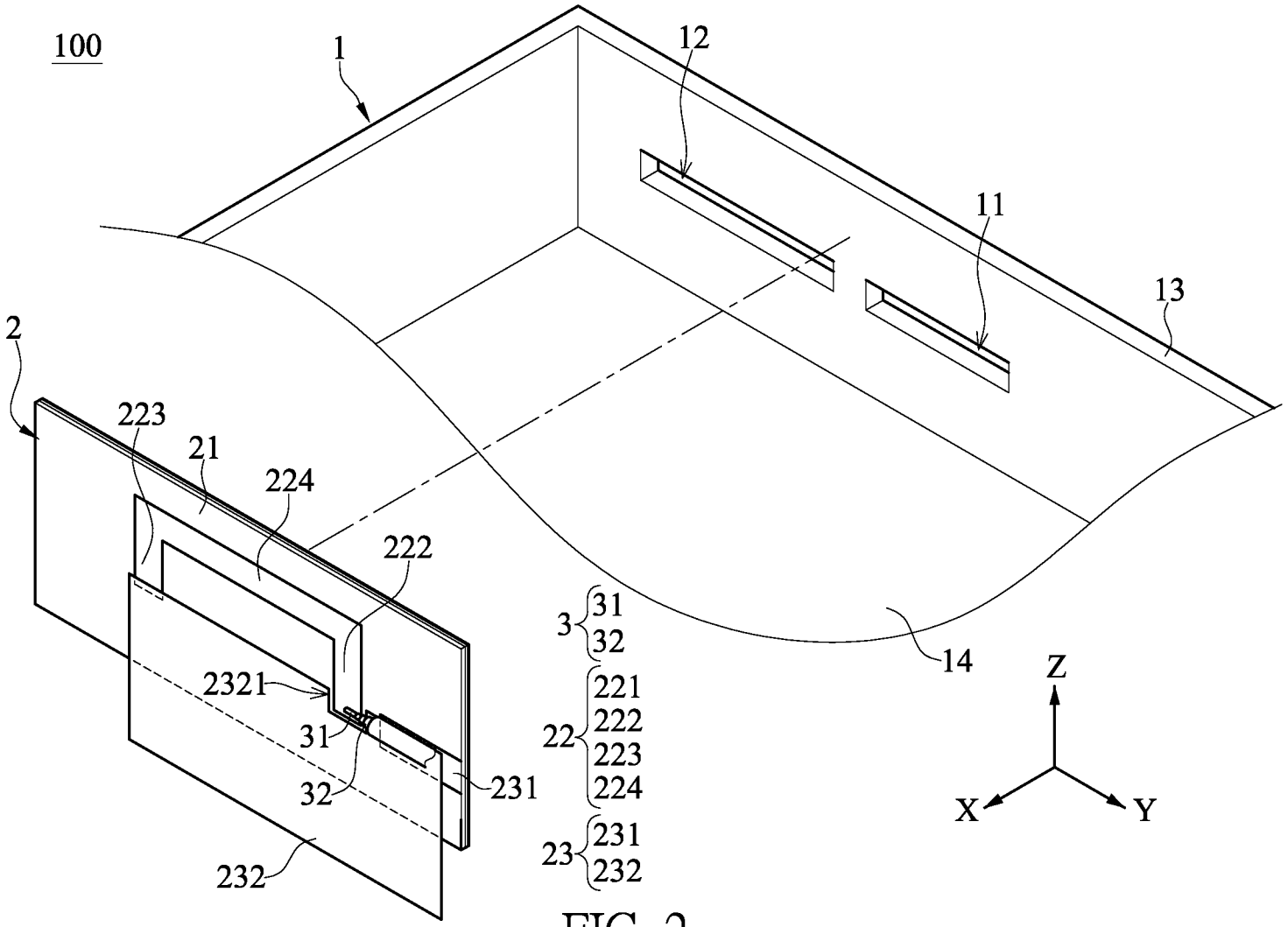
FIG. 2 is a schematic partial exploded view of the electronic device according to the first embodiment of the present disclosure.
Figure 3:
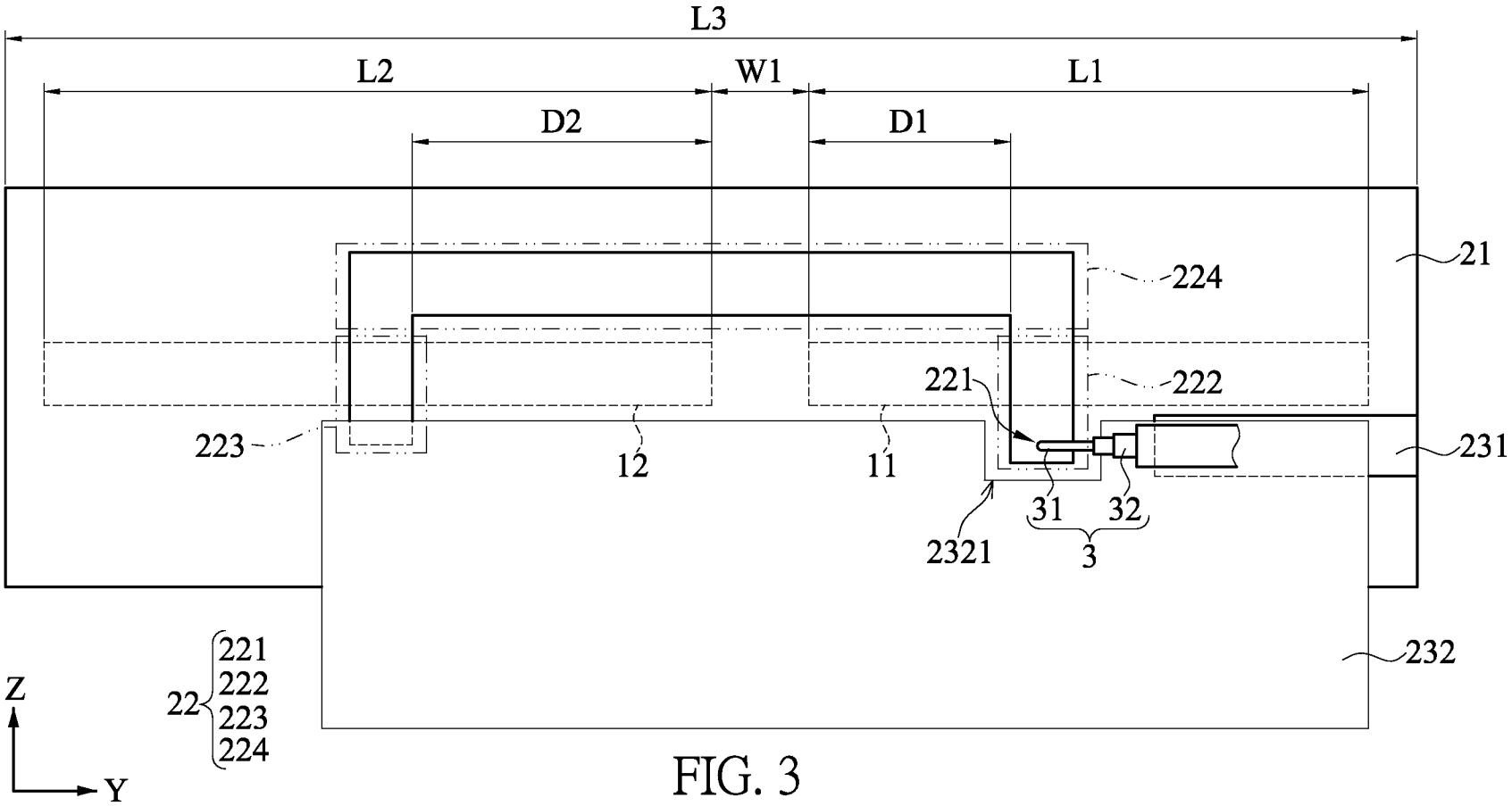
FIG. 3 is a schematic partial side view of the electronic device according to the first embodiment of the present disclosure.

Referring to FIG. 1 to FIG. 3, a first embodiment of the present disclosure provides an electronic device 100 including a metal cover 1 and an antenna module 2. The electronic device 100 in the present embodiment may be a smartphone, a tablet computer, or a notebook, but the present disclosure is not limited thereto. In contrast, the metal cover 1 may be an upper cover or a back cover of the electronic device 100, but the present disclosure is not limited thereto.

The metal cover 1 has two slots respectively defined as a short slot 11 and a long slot 12, and the short slot 11 and the long slot 12 each penetrate the metal cover 1. In actual application, the short slot 11 and the long slot 12 may each be a rectangular closed hole, but the shape of the short slot 11 and the long slot 12 is not limited thereto. A length L1 of the short slot 11 is less than a length L2 of the long slot 12. The difference between the length of the short slot 11 and the length of the long slot 12 can be changed according to requirements, and the present disclosure is not limited thereto.

Referring to FIG. 1, the long slot 12 and the short slot 11 are formed on a narrow side wall 13 of the metal cover 1. However, the long slot 12 and the short slot 11 in another embodiment of the present disclosure can be arranged at any location of the metal cover 1 according to requirements. For example, the long slot 12 and the short slot 11 can also be provided on a wide side wall 14 of the metal cover 1. In addition, the short slot 11 and the long slot 12 in the present embodiment are arranged side by side, and a short side of the short slot 11 and a short side of the long slot 12 are arranged close to each other. Nevertheless, the short slot 11 and the long slot 12 are not limited to be arranged side by side.

The antenna module 2 includes a substrate 21 and an antenna structure 22. The substrate 21 is disposed on a side of the metal cover 1. The antenna structure 22 is a conductive structure and is formed on a surface of the substrate 21. In practical applications, the substrate 21 can be selected as a FR4 (i.e., flame retardant 4) substrate, a printed circuit board (i.e., PCB), or a flexible circuit board (i.e., FCB) according to requirements, but the present disclosure is not limited thereto. The antenna structure 22 may be a conductive sheet structure (e.g., copper foil) formed on the surface of the substrate 21.

The antenna structure 22 defines a feeding portion 221 that is configured to connect to a signal source, and a signal delivered from the signal source is fed into the antenna structure 22 through the feeding portion 221. The antenna structure 22 includes a first excitation segment 222, a second excitation segment 223, and a connection segment 224. Two ends of the connection segment 224 are connected to the first excitation segment 222 and the second excitation segment 223, respectively, and the first excitation segment 222, the second excitation segment 223, and the connection segment 224 are integrally formed on the substrate 21. The first excitation segment 222 may be extended and formed at one of the two ends of the connection segment 224 along an extension direction, and the second excitation segment 223 may be extended and formed at another one of the two ends of the connection segment 224 along the extension direction. The first excitation segment 222, the second excitation segment 223, and the connection segment 224 can jointly form a structure that is similar to an inverted U shape, and the feeding portion 221 is located at the first excitation segment 222.

Referring to FIG. 1 and FIG. 3, the antenna module 2 is fixed onto a side of the metal cover 1 that has the short slot 11 and the long slot 12, at least part of a projection region defined by orthogonally projecting the first excitation segment 222 onto the metal cover 1 overlaps with the short slot 11, and at least part of a projection region defined by orthogonally projecting the second excitation segment 223 onto the metal cover 1 overlaps with the long slot 12. That is, in the side view as shown in FIG. 3, the first excitation segment 222 of the antenna structure 22 is arranged across the short slot 11, and the second excitation segment 223 is arranged across the long slot 12.

As mentioned above, when a signal source is fed into the antenna structure 22 through the feeding portion 221, the antenna structure 22 can interact with the short slot 11 to generate a first frequency band, the antenna structure 22 can interact with the long slot 12 to generate a second frequency band, and the antenna structure 22 as a whole can resonate to generate a third frequency band. A frequency range corresponding to the first frequency band, a frequency range corresponding to the second frequency band, and a frequency range corresponding to the third frequency band are different from each other. Alternatively, a part of the frequency range corresponding to the first frequency band overlaps with a part of the frequency range corresponding to the second frequency band, and a part of the frequency range corresponding to the second frequency band overlaps with a part of the frequency range corresponding to the third frequency band. In the embodiment in which each of the long slot 12 and the short slot 11 is a rectangular closed hole, the length L1 of the short slot 11 is within a range from ½ to 4 times of the wavelength corresponding to a center frequency of the first frequency band. The length L2 of the long slot 12 is within a range from ½ to 4 times of the wavelength corresponding to a center frequency of second first frequency band.

In a specific implementation, the antenna module 2 further includes a grounding member 23 that is a conductive structure and is used for grounding. The ground member 23 includes a first ground structure 231 and a ground plate body 232. The first ground structure 231 is formed on the substrate 21 and may be disposed adjacent to the first excitation segment 222. The ground plate body 232 is coupled with the first ground structure 231 and the second excitation segment 223. In practical applications, the first ground structure 231 and the ground plate body 232 may be integrally connected, or the first ground structure 231 and the ground plate body 232 may be fixed to each other by soldering with a solder, but the present disclosure is not limited thereto. In practical applications, a part of the ground plate body 232 can be fixed to the metal cover 1 by other means.

The electronic device 100 in the present embodiment further includes a coaxial cable 3 having an inner conductor 31 and an outer conductor 32. The inner conductor 31 and the outer conductor 32 are electrically isolated from each other by an insulation structure. The outer conductor 32 is coupled with the first ground structure 231, and the inner conductor 31 is coupled with the feeding portion 221 of the antenna structure 22. The outer conductor 32 may be connected to the ground plate body 232 by soldering with a solder, so that the outer conductor 32 is electrically connected to the first ground structure 231 by the ground plate body 232. The inner conductor 31 may be connected and fixed to the feeding portion 221 of the antenna structure 22 by soldering with a solder. Nevertheless, the outer conductor 32 of the coaxial cable 3 can be directly connected to the first ground structure 231 without passing through the ground plate body 232, and the same connection effect can also be achieved. It is worth mentioning that, the ground plate body 232 may further include a notch 2321 set corresponding to the position of the feeding portion 221, and the notch 2321 is used to prevent positive and negative poles of the coaxial cable 3 from being connected to each other. In actual application, the width of the notch 2321 can be designed according to the position of the feeding portion 221 and the position of the first ground structure 231, and the present disclosure is not limited thereto. In another embodiment, the distance between the feeding portion 221 of the antenna structure 22 and a grounding member for connecting with the coaxial cable 3 is greater than or equal to 2 mm.

In particular, for the electronic device 100 and the antenna module 2 in the specific implementation, a relevant personnel can "adjust the position of the first excitation segment 222 relative to the short slot 11", "adjust the position of the second excitation segment 223 relative to the long slot 12", "change the appearance of the first excitation segment 222", "change the appearance of the second excitation segment 223", and "change the overall size or appearance of the antenna structure 22" to change the frequency range corresponding to the first frequency band, the frequency range corresponding to the second frequency band, and the frequency range corresponding to the third frequency band.

Figure 4:
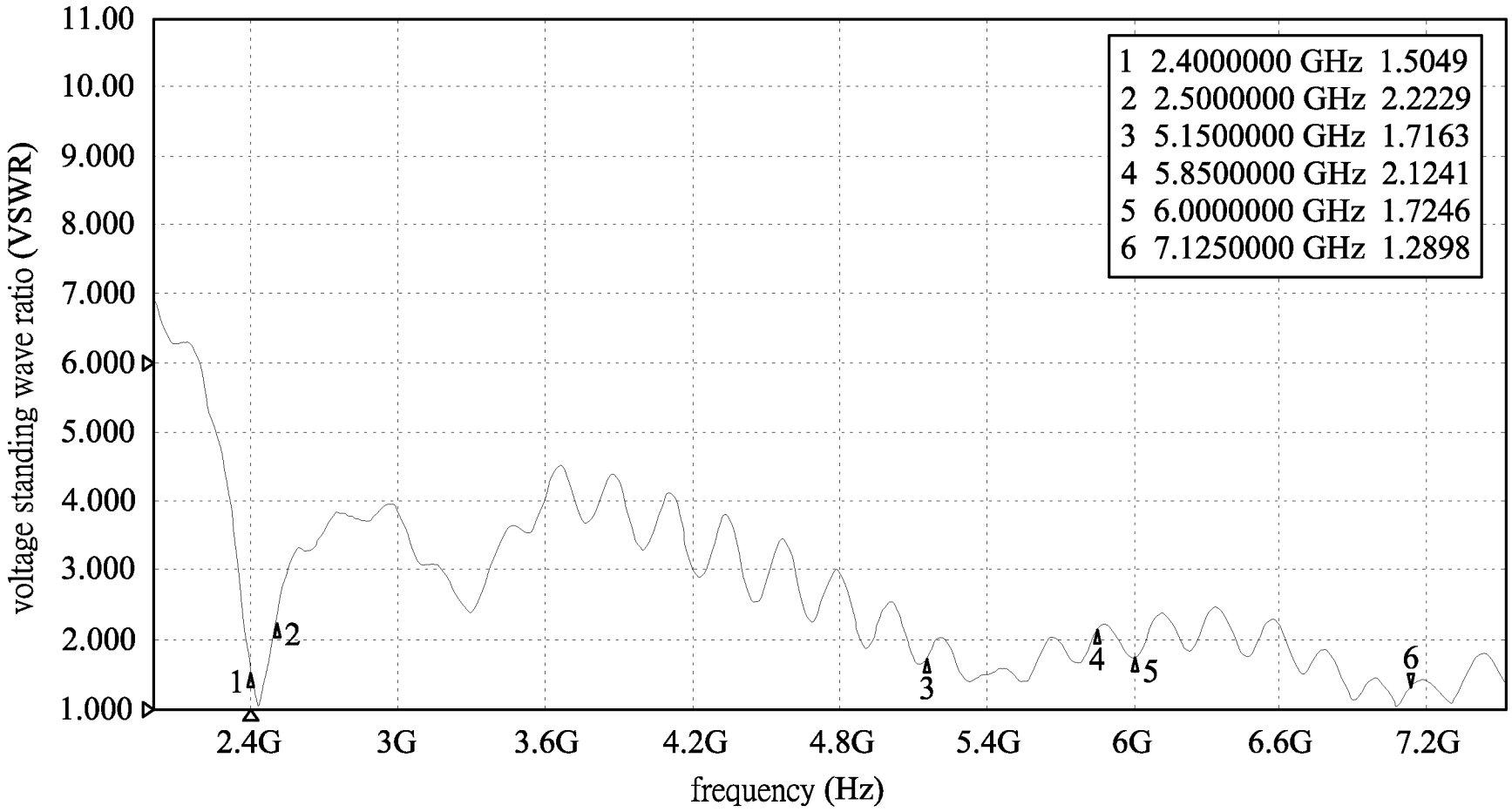
FIG. 4 is a diagram of a voltage standing wave ratio of the electronic device according to the first embodiment of the present disclosure.

Reference is made to FIG. 4, which shows a voltage standing wave ratio of the antenna module 2 of the electronic device 100 in the present embodiment. After the electronic device 100 is fed by the signal source, the voltage standing wave ratio at 2.4 GHz is 1.5049, the voltage standing wave ratio at 2.5 GHz is 2.2229, the voltage standing wave ratio at 5.15 GHz is 1.7163, the voltage standing wave ratio at 5.85 GHz is 2.1241, the voltage standing wave ratio at 6 GHz is 1.7246, and the voltage standing wave ratio at 7.125 GHz is 1.2898. That is, the electronic device 100 and the antenna module 2 of the present embodiment can support broadband operations of WI-FI® 6E, 2.4 GHz and 5 GHz that are commonly used today.

Figure 5:
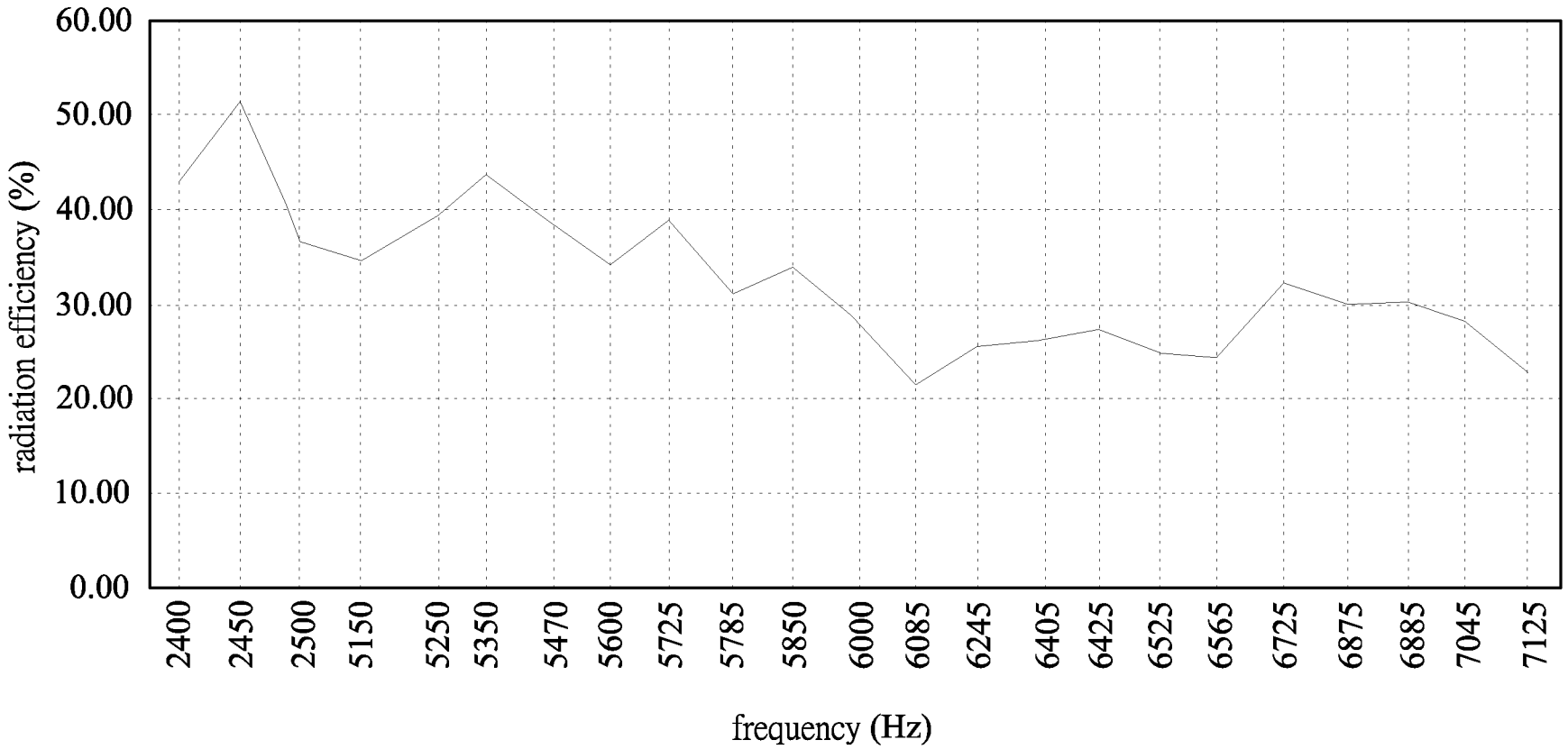
FIG. 5 is a diagram of a radiation efficiency of the electronic device according to the first embodiment of the present disclosure.

Reference is made to FIG. 5, which shows a radiation efficiency of the antenna module 2 of the electronic device 100 in the present embodiment. When the antenna module 2 is in three frequency bands that are respectively within a range from 6000 to 7125 MHz, a range from 2310 to 2600 MHz, and a range from 5150 to 5850 MHz, the radiation efficiency of the antenna module 2 is above 20%. That is, the antenna module 2 of the present embodiment already meets the application requirements of WI-FI® 6E, 2.4 GHz and 5 GHz that are commonly used today. It should be noted that the frequency band in the present embodiment and within the range from 6000 to 7125 MHz is defined as the first frequency band, the frequency band in the present embodiment and within the range from 2310 to 2600 MHz is defined as the second frequency band, and the frequency band in the present embodiment and within the range from 5150 to 5850 MHz is defined as the third frequency band.

Moreover, the first frequency band (e.g., the range from 6000 to 7125 MHz) in practice is applied to WI-FI® 6E.

Referring to FIG. 3, in order to enable the antenna structure 22 of the electronic device 100 to better generate the three frequency bands that are respectively within the range from 6000 to 7125 MHz, the range from 2310 to 2600 MHz, and the range from 5150 to 5850 MHz, the short slot 11 in practical applications is a rectangular closed hole, a shortest distance D1 between the first excitation segment 222 and a side wall of the short slot 11 is less than or equal to 10 mm, the long slot 12 in practical applications is a rectangular closed hole, and a shortest distance D2 between the second excitation segment 223 and a side wall of the short slot 12 is less than or equal to 10 mm.

Referring to FIG. 2 and FIG. 3, it should be noted that a length L3 of the substrate 21 is greater than or equal to a sum of a width W1 of a gap between the long slot 12 and the short slot 11, the length L1 of the short slot 11 and the length L2 of the long slot 12 (i.e., L3≥W1+L1+L2). When the substrate 21 is fixed onto the metal cover 1, the substrate 21 correspondingly shields the long slot 12 and the short slot 11. Nevertheless, the present embodiment does not limit that the substrate 21 must completely shield the long slot 12 and the short slot 11 when the substrate 21 is fixed to the side of the metal cover 1. In other words, the electronic device 100 only needs to satisfy the conditions of "the projection region defined by orthogonally projecting the first excitation segment 222 onto the metal cover 1 overlaps with the short slot 11" and "the projection region defined by orthogonally projecting the second excitation segment 223 onto the metal cover 1 overlaps with the long slot 12".

Second Embodiment

Figure 6:
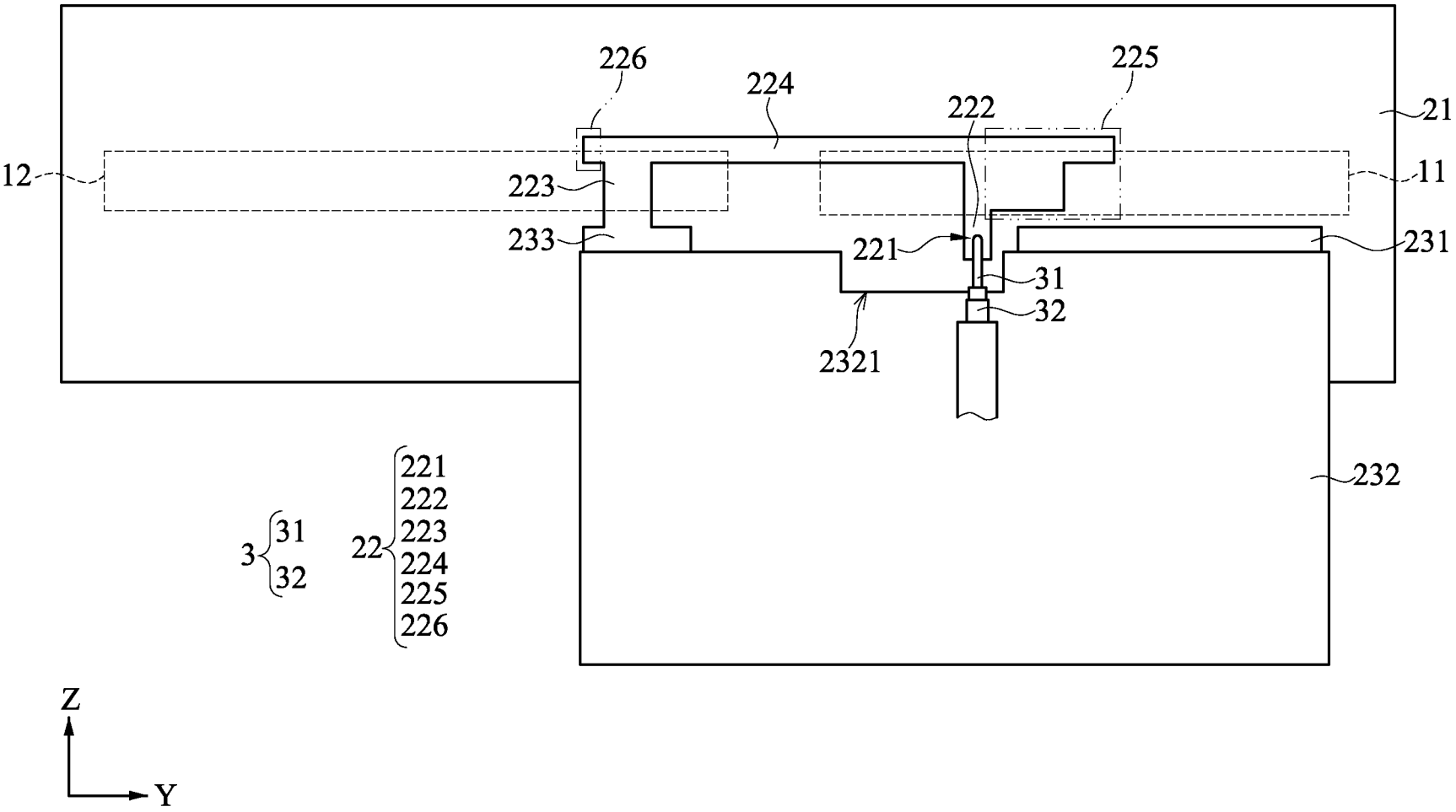
FIG. 6 is a schematic partial side view of an electronic device according to a second embodiment of the present disclosure.

Reference is made to FIG. 6, which shows a schematic partial side view of an electronic device 100 according to a second embodiment of the present disclosure. A main difference between the present embodiment and the first embodiment is that the ground member 23 further includes a second ground structure 233 that is connected to the second excitation segment 223 and coupled with the ground plate body 232. In actual application, the second ground structure 233 and the second excitation segment 223 may be integrally connected, or the second ground structure 233 and the ground plate body 232 are fixed to each other by soldering with a solder.

Another difference between the present embodiment and the first embodiment is that the antenna structure 22 further includes two frequency adjustment segments that are respectively defined as a first frequency adjustment segment 225 and a second frequency adjustment segment 226. The first frequency adjustment segment 225 is connected to the connection segment 224 and the first excitation segment 222, and at least part of projection region defined by orthogonally projecting the first frequency adjustment segment 225 onto the metal cover 1 overlaps with the short slot 11. The relevant personnel can change the shape and size of the first frequency adjustment segment 225, as well as its position relative to the short slot 11, so as to adjust the frequency range from the first frequency band generated by the antenna module 2 when the signal source is fed into the antenna module 2. That is, the first frequency adjustment segment 225 is mainly used to adjust the frequency range from the antenna module 2 in the WI-FI® 6E frequency band.

The second frequency adjustment segment 226 is connected to the connection segment 224 and the second excitation segment 223, and at least part of projection region defined by orthogonally projecting the second frequency adjustment segment 226 onto the metal cover 1 overlaps with the long slot 12. The relevant personnel can change the shape and size and position of the second frequency adjustment segment 226, as well as its position relative to the long slot 12, so as to adjust the frequency range from the second frequency band generated by the antenna module 2 when the signal source is fed into the antenna module 2 is adjusted. That is, the second frequency adjustment segment 226 is mainly used to adjust the frequency range from the antenna module 2 in the 2.4G frequency band. Regarding the drawings of the present embodiment, the appearance of the first frequency adjustment segment 225 and the second frequency adjustment segment 226 can be designed according to requirements, and the present disclosure is not limited thereto.

Third Embodiment

Figure 7:
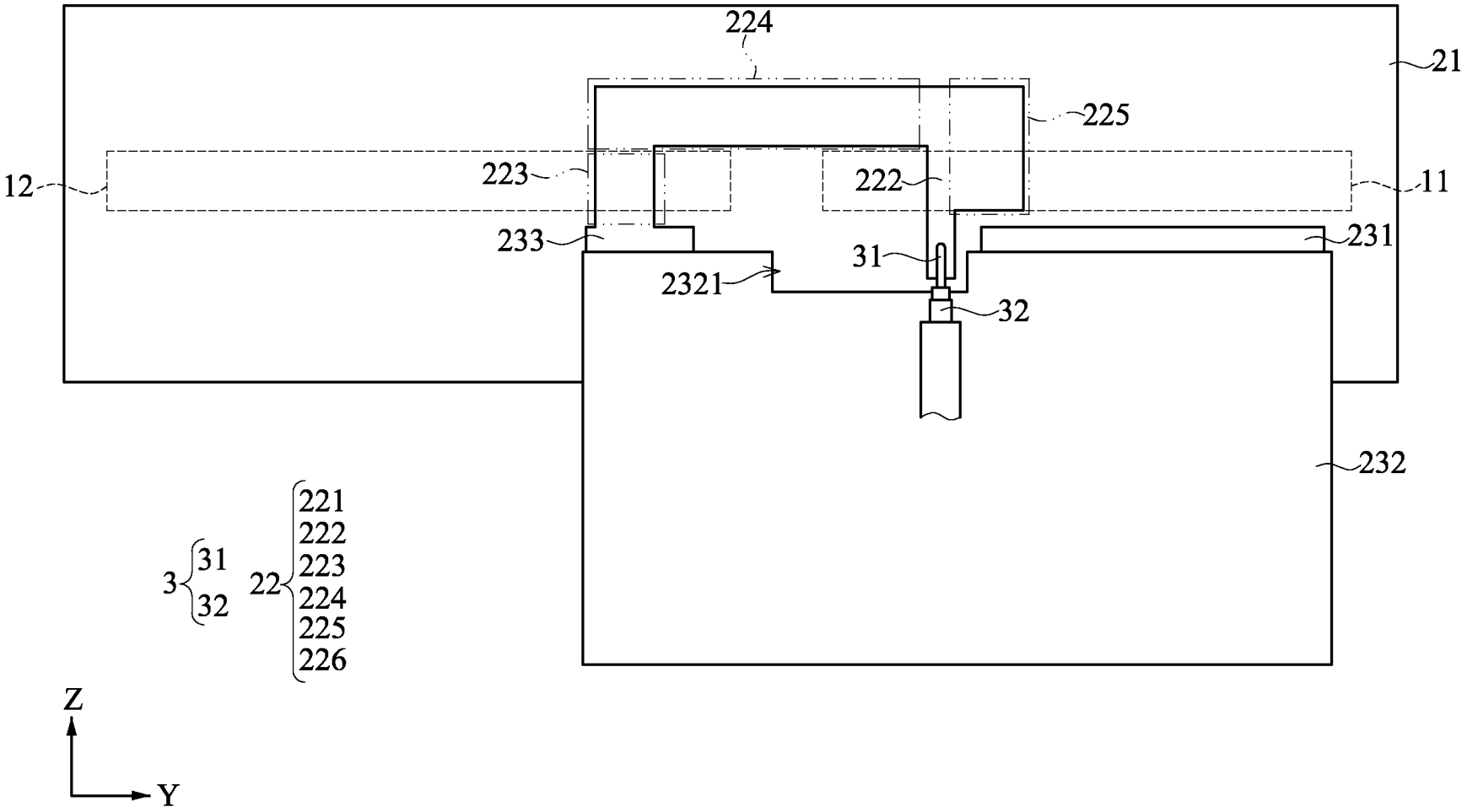
FIG. 7 is a schematic partial side view of an electronic device according to a third embodiment of the present disclosure.

Reference is made to FIG. 7, which shows a schematic partial side view of an electronic device according to a third embodiment of the present disclosure. A main difference between the present embodiment and the first embodiment is that a projection region defined by orthogonally projecting the connection segment 224 of the antenna structure 22 onto the metal cover 1 may not be overlapped with the long slot 12 and the short slot 11 at all (as shown in FIG. 2).

Fourth Embodiment

Figure 8:
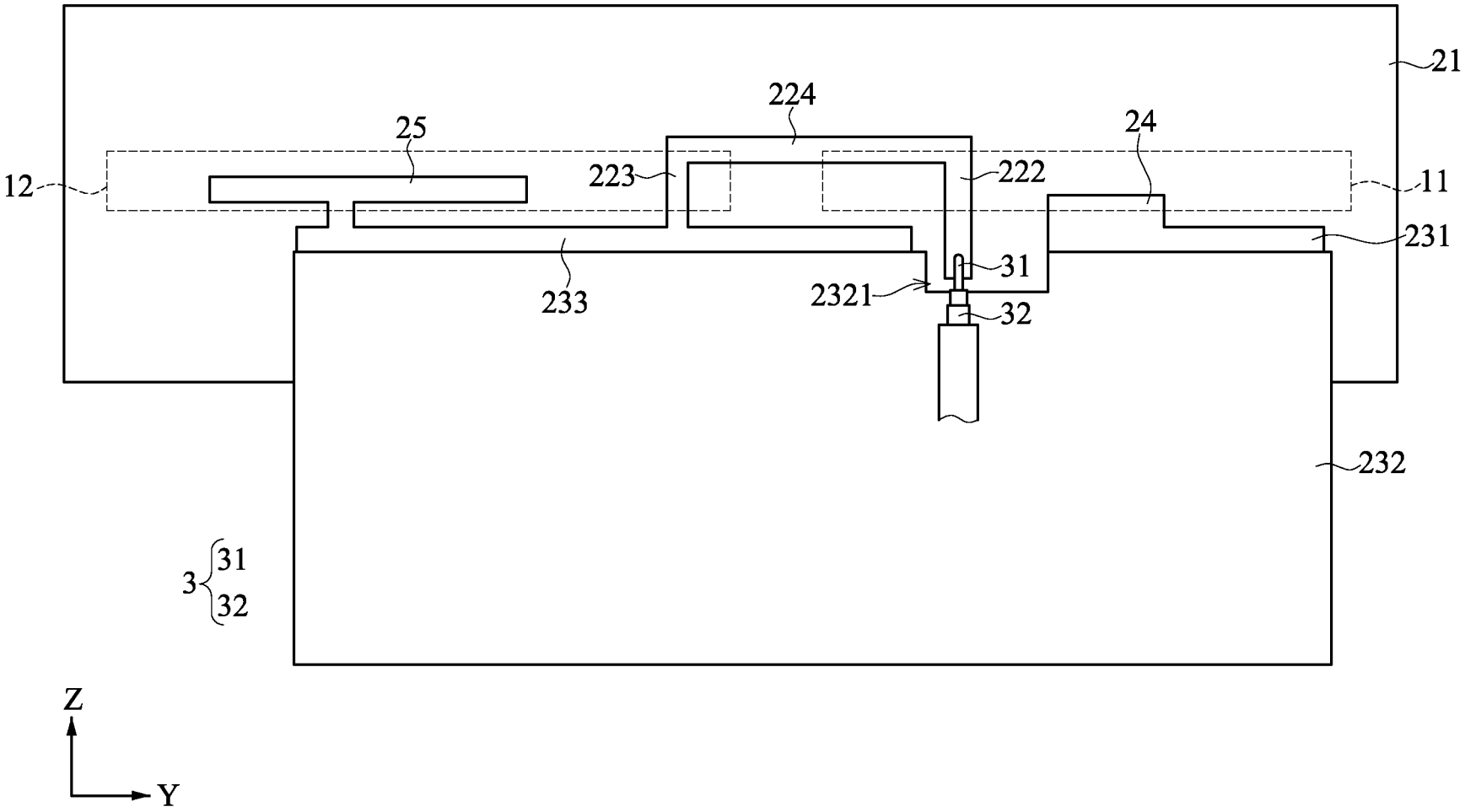
FIG. 8 is a schematic partial side view of an electronic device according to a fourth embodiment of the present disclosure.

Reference is made to FIG. 8, which shows a schematic partial side view of an electronic device according to a fourth embodiment of the present disclosure. A main difference between the present embodiment and the first embodiment is that the antenna structure 22 further includes two frequency adjustment branch members defined as a first frequency adjustment branch member 24 and a second frequency adjustment branch member 25. The first frequency adjustment branch member 24 is connected to the first ground structure 231 and coupled with the ground plate body 232, and the second frequency adjustment branch member 25 is connected to the second ground structure 233 and coupled with the ground plate body 232.

At least part of a projection region defined by orthogonally projecting the first frequency adjustment branch member 24 onto the metal cover 1 overlaps with the short slot 11, and at least part of a projection region defined by orthogonally projecting the second frequency adjustment branch member 25 onto the metal cover 1 overlaps with the long slot 12. In actual application, the first frequency adjustment branch member 24 and the first grounding structure 231 may be integrally formed, and the second frequency adjustment branch member 25 and the second ground structure 233 may be integrally formed. In another embodiment, the first grounding structure 231, the ground plate body 232, the second ground structure 233, the first frequency adjustment branch member 24 and the second frequency adjustment branch member 25 may be integrally formed. In actual application, when the signal source is fed into the antenna structure 22, the frequency range corresponding to the first frequency band generated by the interaction of the antenna structure 22 and the short slot 11 can be adjusted by the relevant personnel through changing the appearance and size of the first frequency adjustment branch member 24, as well as its position relative to the short slot 11. When the signal source is fed into the antenna structure 22, the frequency range corresponding to the second frequency band generated by the interaction of the antenna structure 22 and the short slot 11 can be adjusted by the relevant personnel through changing the appearance and size of the second frequency adjustment branch member 25, as well as its position relative to the short slot 11.

Fifth Embodiment

Figure 9:
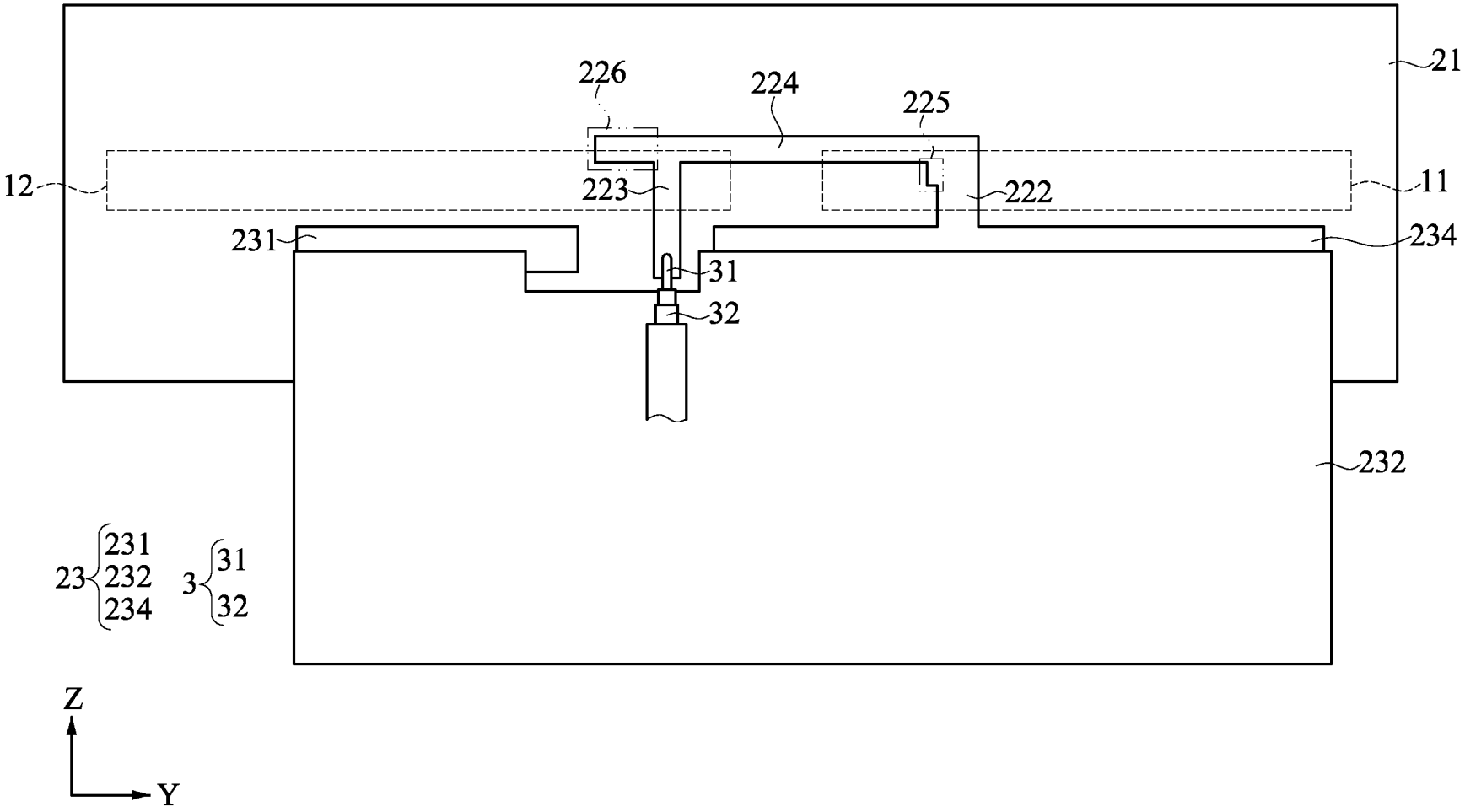
FIG. 9 is a schematic partial side view of an electronic device according to a fifth embodiment of the present disclosure.

Reference is made to FIG. 9, which shows a schematic side view of an electronic device according to a fifth embodiment of the present disclosure. A main difference between the present embodiment and the first embodiment is that the feeding portion 221 may be located at an end of the second excitation segment 223 opposite to a junction between the second excitation segment 223 and the connection segment 224, and the feeding portion 221 is correspondingly arranged adjacent to the long slot 12. Another difference between the present embodiment and the first embodiment is that the grounding member 23 includes a first ground structure 231, a ground plate body 232, and a third ground structure 234. The first ground structure 231 is disposed adjacent to the second excitation segment 223. The third ground structure 234 is a conductive structure and is formed on the substrate 21. The third ground structure 234 is connected to the first excitation segment 222, and the third ground structure 234 is coupled with the ground plate body 232. In actual application, the third ground structure 234 and the first excitation segment 222 may be integrally formed. The ground plate body 232 may be fixed onto the third ground structure 234 by soldering with a solder, or the ground plate body 232 and the third ground structure 234 may also be integrally formed. As described in the previous embodiment and the present embodiment, the feeding portion 221 of the antenna structure 22 of the electronic device 100 of the present disclosure may be designed in the first excitation segment 222 or the second excitation segment 223 according to requirements. That is, the feeding portion 221 can be arranged adjacent to the short slot 11 or the long slot 12. If the feeding portion 221 is arranged in the first excitation segment 222, performance of the antenna structure 22 in the second frequency band would be helped. For example, the efficiency of the antenna structure 22 in the second frequency band can be improved. In contrast, if the feeding portion 221 is arranged in the second excitation segment 223, performance of the antenna structure 22 in the first frequency band would be helped. More specifically, the performance of the antenna module 2 in the 2.4 G frequency band is improved when the feeding portion 221 is arranged in the first excitation segment 222, and the performance of the antenna module 2 in the WI-FI® 6E frequency band is improved when the feeding portion 221 is arranged in the second excitation segment 223.

Another difference between the present embodiment and the first embodiment is that the first frequency adjustment segment 225 is connected to a junction between the first excitation segment 222 and the connection segment 224. The second frequency adjustment segment 226 is connected to the second excitation segment 223, and arranged at a junction between the second excitation segment 223 and the connection segment 224. More specifically, the first frequency adjustment segment 225 can be a rectangular structure, a short side of the first frequency adjustment segment 225 is connected to the connection segment 224, and a long side of the first frequency adjustment segment 225 is connected to the first excitation segment 222. The second frequency adjustment segment 226 can be a rectangular structure, and a short side of the second frequency adjustment segment 226 is connected to the connection segment 224.

In the specific implementation as described above, the relevant personnel can slightly adjust the frequency range from the first frequency band, the frequency range from the second frequency band, and the frequency range from the third frequency band generated by the antenna module 2 by changing the appearance, size, and arrangement position of the first frequency adjustment segment 225 and the second frequency adjustment segment 226. That is, the appearance, size, and arrangement position of the first frequency adjustment segment 225 and the second frequency adjustment segment 226 shown in the drawing of the present embodiment are only one of the implementation aspects, and the actual application is not limited thereto.

Sixth Embodiment

Figure 10:
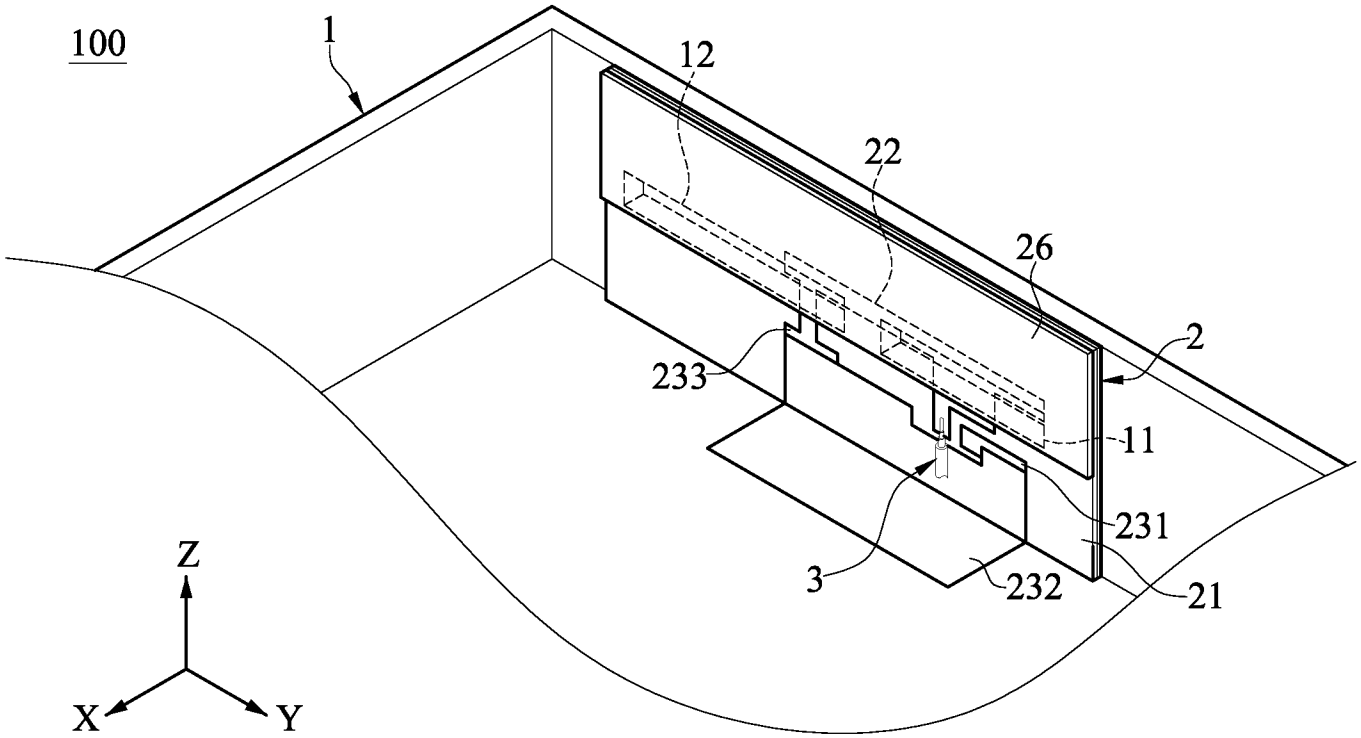
FIG. 10 is a schematic partial perspective view of an electronic device according to a sixth embodiment of the present disclosure.
Figure 11:
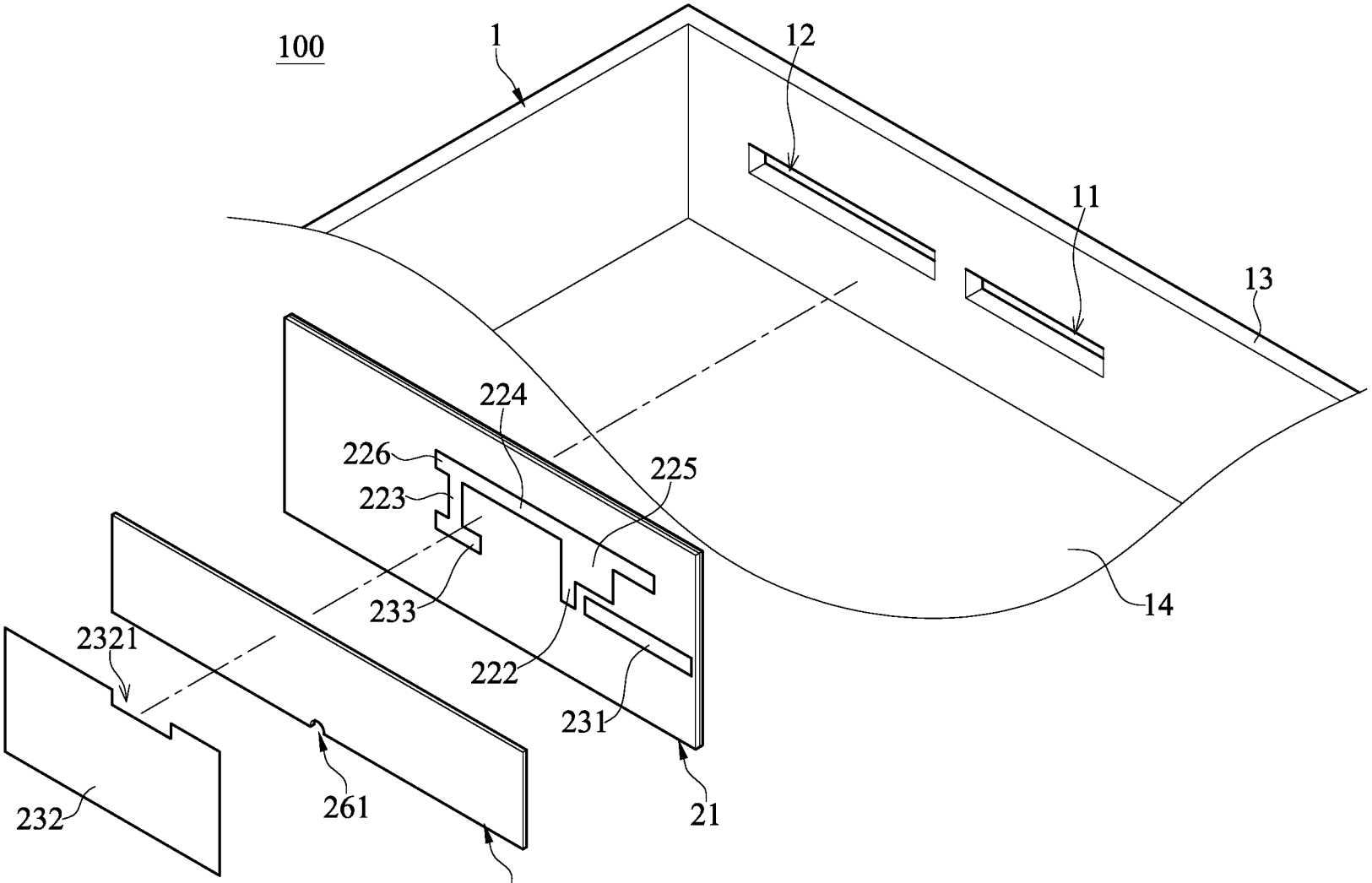
FIG. 11 is a schematic partial exploded view of the electronic device according to the sixth embodiment of the present disclosure.
Figure 12:
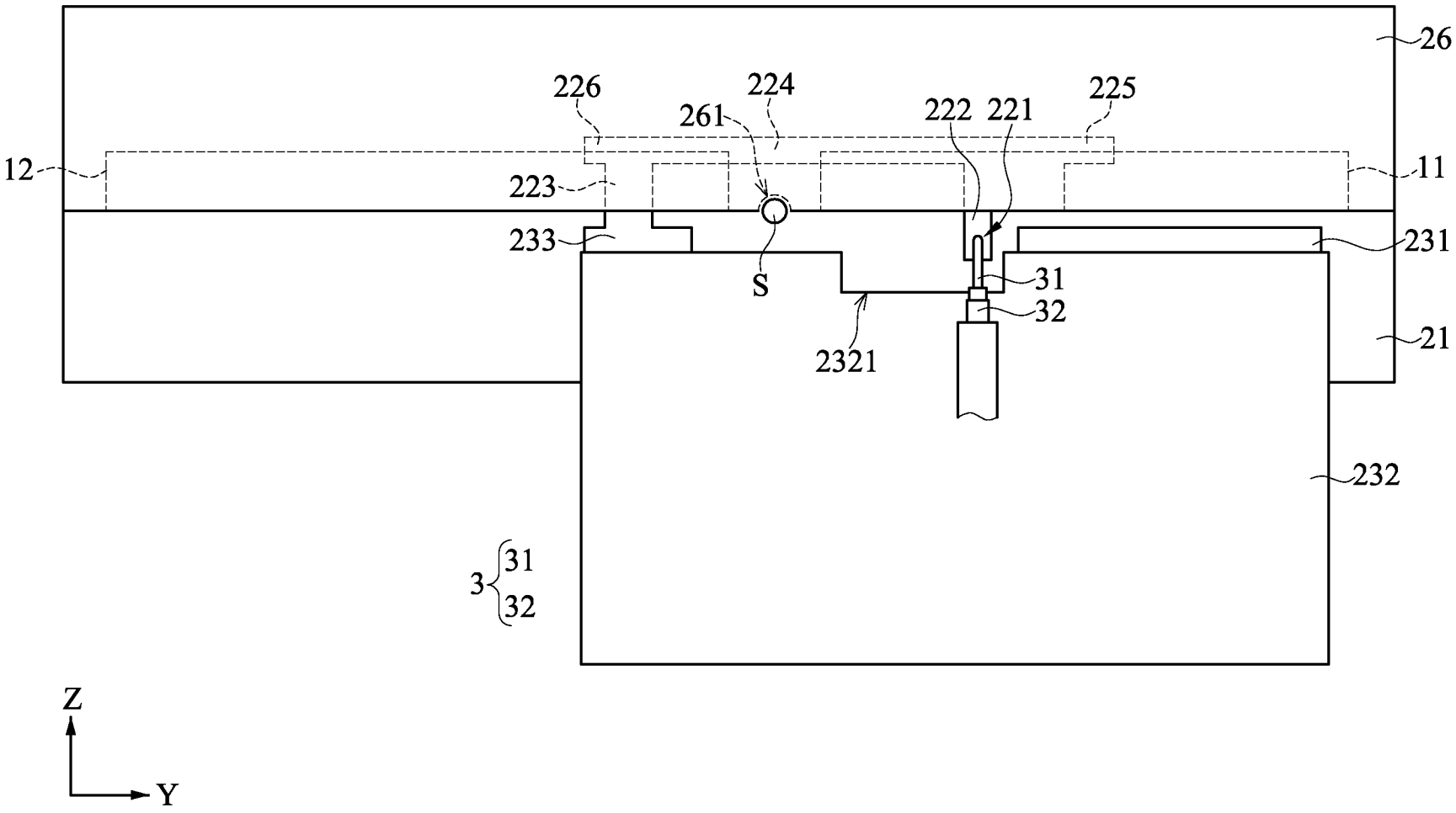
FIG. 12 is a schematic partial side view of the electronic device according to the sixth embodiment of the present disclosure.

Reference is made to FIG. 10 to FIG. 12, FIG. 10 shows a schematic partial perspective view of an electronic device according to a sixth embodiment of the present disclosure, FIG. 11 shows a schematic partial exploded view of the electronic device according to the sixth embodiment of the present disclosure, and FIG. 12 shows a schematic partial side view of the electronic device according to the sixth embodiment of the present disclosure. A main difference between the present embodiment and the first embodiment is that the antenna module 2 further includes an auxiliary frequency adjustment member 26 disposed on the surface of the substrate 21, and the antenna structure 22 is arranged between the auxiliary frequency adjustment member 26 and the substrate 22. The auxiliary frequency adjustment member 26 is a dielectric material. For example, the auxiliary frequency adjustment member 26 can be a component composed of polymer, ceramic, or other composite materials. When the auxiliary frequency adjustment member 26 is fixed onto the substrate 21, the auxiliary frequency adjustment member 26 correspondingly shields at least part of the first excitation segment 222, at least part of the second excitation segment 223, and at least part of the connection segment 224.

In actual application, the relevant personnel can adjust the frequency ranges corresponding to the first frequency band, the second frequency band, and third frequency band generated by the antenna module 2 after the signal source is fed into the antenna module 2 by selecting the auxiliary frequency adjustment member 26 with different dielectric constants. In addition, in practical applications, the substrate 21 may be fixed onto the metal cover 1 by a screw S. The auxiliary frequency adjustment member 26 may include an avoiding hole 261 for avoiding the screw S, and the screw S does not need to be fixed onto the auxiliary frequency adjustment member 26.

In conclusion, the electronic device and the antenna module of the present embodiment can generate three different frequency bands after the signal source is fed thereinto, so that the antenna module can be applied to electronic devices with a small size or installation space.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electronic device, comprising:

a metal cover having two slots, wherein the two slots are respectively defined as a short slot and a long slot, and a length of the short slot is less than a length of the long slot, and wherein the short slot and the long slot each penetrate the metal cover and are arranged side by side; and an antenna module including:

a substrate disposed on a side of the metal cover; and an antenna structure being a conductive structure and formed on a surface of the substrate, wherein the antenna structure defines a feeding portion, and wherein the antenna structure includes:

a first excitation segment, wherein at least part of a projection region defined by orthogonally projecting the first excitation segment onto the metal cover overlaps with the short slot;

a second excitation segment, wherein at least part of a projection region defined by orthogonally projecting the second excitation segment onto the metal cover is overlapped with the long slot; and a connection segment connected to the first excitation segment and the second excitation segment;

wherein, when a signal source is fed into the antenna structure through the feeding portion, the antenna structure and the short slot are configured to generate a first frequency band, the antenna structure and the long slot are configured to generate a second frequency band, and the antenna structure is configured to generate a third frequency band, and wherein a frequency range corresponding to the first frequency band, a frequency range corresponding to the second frequency band, and a frequency range corresponding to the third frequency band are different from each other.

2. The electronic device according to claim 1, wherein the short slot is a rectangular closed hole, and a shortest distance between the first excitation segment and a side wall of the short slot is less than or equal to 10 mm.

3. The electronic device according to claim 1, wherein the long slot is a rectangular closed hole, and a shortest distance between the second excitation segment and a side wall of the long slot is less than or equal to 10 mm.

4. The electronic device according to claim 1, wherein the short slot is a rectangular closed hole, wherein a length of the short slot is within a range from ½ to 4 times of a wavelength corresponding to a center frequency of the first frequency band, wherein the long slot is a rectangular closed hole, and wherein the length of the long slot is within a range from ½ to 4 times of the wavelength corresponding to a center frequency of the second frequency band.

5. The electronic device according to claim 1, wherein a frequency range from the first frequency band is within a range from 6000 to 7125 MHz, a frequency range from the second frequency band is within a range from 2310 to 2600 MHz, and a frequency range from the third frequency band is within a range from 5150 to 5850 MHz.

6. The electronic device according to claim 1, wherein the antenna module further includes a grounding member connected to the second excitation segment, and wherein the feeding portion is located at the first excitation segment.

7. The electronic device according to claim 6, wherein the antenna structure further includes at least one frequency adjustment branch member coupled with the grounding member, and wherein a projection region defined by orthogonally projecting the at least one frequency adjustment branch member onto the metal cover overlaps with at least one of at least part of the short slot and at least part of the long slot.

8. The electronic device according to claim 1, wherein the antenna module further includes a grounding member connected to the first excitation segment, and wherein the feeding portion is located at the second excitation segment.

9. The electronic device according to claim 8, wherein the antenna structure further includes at least one frequency adjustment branch member coupled with the grounding member, and wherein a projection region defined by orthogonally projecting the at least one frequency adjustment branch member onto the metal cover overlaps with at least one of at least part of the short slot and at least part of the long slot.

10. The electronic device according to claim 1, wherein the antenna structure further includes at least one frequency adjustment segment connected to a junction between the first excitation segment and the connection segment, and wherein at least part of a projection region defined by orthogonally projecting the at least one frequency adjustment segment onto the metal cover overlaps with the short slot.

11. The electronic device according to claim 1, wherein the antenna structure further includes at least one frequency adjustment segment connected to a junction between the second excitation segment and the connection segment, and wherein at least part of a projection region defined by orthogonally projecting the at least one frequency adjustment segment onto the metal cover overlaps with the long slot.

12. The electronic device according to claim 1, wherein the antenna module further includes an auxiliary frequency adjustment member disposed on the surface of the substrate, and the antenna structure is arranged between the auxiliary frequency adjustment member and the substrate, and wherein the auxiliary frequency adjustment member is a dielectric material.

13. An antenna module for being fixed onto a metal cover that has a short slot and a long slot, wherein a length of the short slot is less than a length of the long slot, and the short slot and the long slot each penetrate the metal cover and are arranged side by side, the antenna module comprising:

a substrate disposed on a side of the metal cover; and an antenna structure being a conductive structure and formed on a surface of the substrate, wherein the antenna structure defines a feeding portion, and wherein the antenna structure includes:

a connection segment;

a first excitation segment extending from one end of the connection segment along an extension direction, wherein at least part of a projection region defined by orthogonally projecting the first excitation segment onto the metal cover overlaps with the short slot; and a second excitation segment extending from another end of the connection segment along the extension direction, wherein at least part of a projection region defined by orthogonally projecting the second excitation segment onto the metal cover overlaps with the long slot;

wherein, when a signal source is fed into the antenna structure through the feeding portion, the antenna structure and the short slot are configured to generate a first frequency band, the antenna structure and the long slot are configured to generate a second frequency band, and the antenna structure is configured to generate a third frequency band.

14. The antenna module according to claim 13, further comprising a grounding member connected to the second excitation segment, and wherein the feeding portion is located at the first excitation segment.

15. The antenna module according to claim 13, further comprising a grounding member connected to the first excitation segment, and wherein the feeding portion is located at the second excitation segment.

16. The antenna module according to claim 13, wherein the antenna structure further includes at least one frequency adjustment segment connected to a junction between the first excitation segment and the connection segment.

17. The antenna module according to claim 13, wherein the antenna structure further includes at least one frequency adjustment segment connected to a junction between the second excitation segment and the connection segment.

18. The antenna module according to claim 13, further comprising an auxiliary frequency adjustment member disposed on the surface of the substrate, the auxiliary frequency adjustment member shields the antenna structure, and the antenna structure is arranged between the auxiliary frequency adjustment member and the substrate, and wherein the auxiliary frequency adjustment member is a dielectric material.

19. The antenna module according to claim 13, wherein a frequency range from the first frequency band is within a range from 6000 to 7125 MHz, a frequency range from the second frequency band is within a range from 2310 to 2600 MHz, and a frequency range from the third frequency band is within a range from 5150 to 5850 MHz.

* * * * *